US006758715B2

(12) United States Patent
Banks

(10) Patent No.: US 6,758,715 B2
(45) Date of Patent: Jul. 6, 2004

(54) SHAPED BALLOON HAVING TRANSPARENT PORTION

(76) Inventor: Emily M. Banks, 3861 Coastal Hwy., St. Augustine, FL (US) 32084

( * ) Notice: Subject to any disclaimer, the term of this patent is extended or adjusted under 35 U.S.C. 154(b) by 0 days.

(21) Appl. No.: 10/177,094

(22) Filed: Jun. 21, 2002

(65) Prior Publication Data

US 2003/0236049 A1 Dec. 25, 2003

(51) Int. Cl.[7] ..... A63H 3/06
(52) U.S. Cl. ..... 446/221; 446/186; 446/226
(58) Field of Search ..... 446/186, 187, 446/220, 221, 180, 223–226; 206/522; 383/3; 40/538

(56) References Cited

U.S. PATENT DOCUMENTS

| | | | | |
|---|---|---|---|---|
| 1,549,790 A | * | 8/1925 | Neusella | 446/220 |
| 3,693,266 A | * | 9/1972 | Pressman | 434/300 |
| 4,837,955 A | * | 6/1989 | Grabhorn | 40/214 |
| 4,917,646 A | | 4/1990 | Kieves | |
| 4,966,568 A | * | 10/1990 | Nakamura et al. | 446/221 |
| 5,041,047 A | * | 8/1991 | Casale | 446/220 |
| 5,108,339 A | | 4/1992 | Kieves | |
| 5,169,353 A | | 12/1992 | Myers | |
| 5,259,805 A | | 11/1993 | Kieves | |
| 5,338,243 A | | 8/1994 | Kieves | |
| 5,713,777 A | | 2/1998 | Greenwald | |
| 5,769,685 A | * | 6/1998 | Nakamura et al. | 446/221 |
| 5,819,448 A | | 10/1998 | Kieves et al. | |
| D414,222 S | | 9/1999 | Kieves et al. | |
| D415,841 S | | 10/1999 | Kieves et al. | |
| 6,076,758 A | | 6/2000 | Kieves et al. | |

FOREIGN PATENT DOCUMENTS

GB 2300128 A * 10/1996 ..... A63H/27/10

* cited by examiner

*Primary Examiner*—Jacob K. Ackun
*Assistant Examiner*—Bena B. Miller
(74) *Attorney, Agent, or Firm*—Knoble Yoshida & Dunleavy, LLC

(57) ABSTRACT

A balloon device includes a plurality of aesthetically discrete balloon members, wherein at least a first one of the aesthetically discrete inflatable members defines a first aesthetic moiety, at least a second balloon member defines a second aesthetic moiety; and a connecting member connecting member that connects the balloon members has an appearance that maintains an aesthetic separation between the first and second aesthetic moieties. The connecting member may be transparent, translucent, or have a color that matches the color of a background where the balloon device is intended to be displayed.

22 Claims, 5 Drawing Sheets

SHAPED BALLOON HAVING TRANSPARENT PORTION

BACKGROUND OF THE INVENTION

1. Field of the Invention

This invention relates to inflatable decorative objects such as balloons. More specifically, this invention relates to non-latex inflatable articles such as balloon toys and decorations that are shaped so as to provide an enhanced decorative or suggestive visual effect.

2. Description of the Related Technology

Balloons have been used for many generations as toys and as decoration for parties and other festive events. The most common and the most popular types of balloons are fabricated from a latex rubber material. More recently, a specialized type of non latex party balloons have been widely commercialized. Non-latex balloons are typically fabricated from a thin resin film and are characterized in that they tend to be less elastic and therefore more rigid when filled than latex balloons.

A wide array of different types of balloon toys and decorations are now commercially available. Some of these decorations provide one or more balloons within another either partially or fully transparent outer enclosure or balloon. In other instances, only one internal balloon is provided within the outer balloon, but it is formed in a complex, multicolored shape so as to create the appearance of more than one structure. Since the internal balloons typically need to be inflated individually prior to inflation of the outer enclosure or balloon, minimizing the number of the internal balloons that need to be inflated is a generally worthwhile goal.

The quality and the nature of the aesthetic effect that is achieved by the arrangement of the inner balloons with respect to each other and with respect to the outer enclosure is of course quite important in determining the overall aesthetic effect of the decoration. To that end, any improvements that can be made in the area of improving the quality of the aesthetic effect are welcome in the industry, and need exists in the industry for any improvements in this area.

SUMMARY OF THE INVENTION

Accordingly, it is an objective to the present invention to provide a balloon decoration that improves the quality of the aesthetic effect that is achieved by having a number of visually discrete structures created by one or more inflatable balloons.

In order to achieve the above and other objects of the invention, a balloon device that is constructed according to a first aspect of the invention includes an inflatable encapsulation member that has at least one portion that is substantially transparent; a first balloon member positioned within the inflatable encapsulation member, the first balloon member defining a first aesthetic moiety; a second balloon member positioned within the inflatable encapsulation member, the second balloon member defining a second aesthetic moiety; and a connecting member attached at a first location to the first balloon member and attached at a second location to the second balloon member, and wherein the connecting member has an appearance that maintains an aesthetic separation between the first and second aesthetic moieties.

A balloon device according to a second aspect of the invention includes a first balloon member that defines a first aesthetic moiety; a second balloon member that defines a second aesthetic moiety; and transparent structure connecting the first and second aesthetically balloon members, and wherein the first balloon member, the second balloon member and the transparent structure are configured and arranged so as to maintain an aesthetic separation between the first and second aesthetic moieties.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
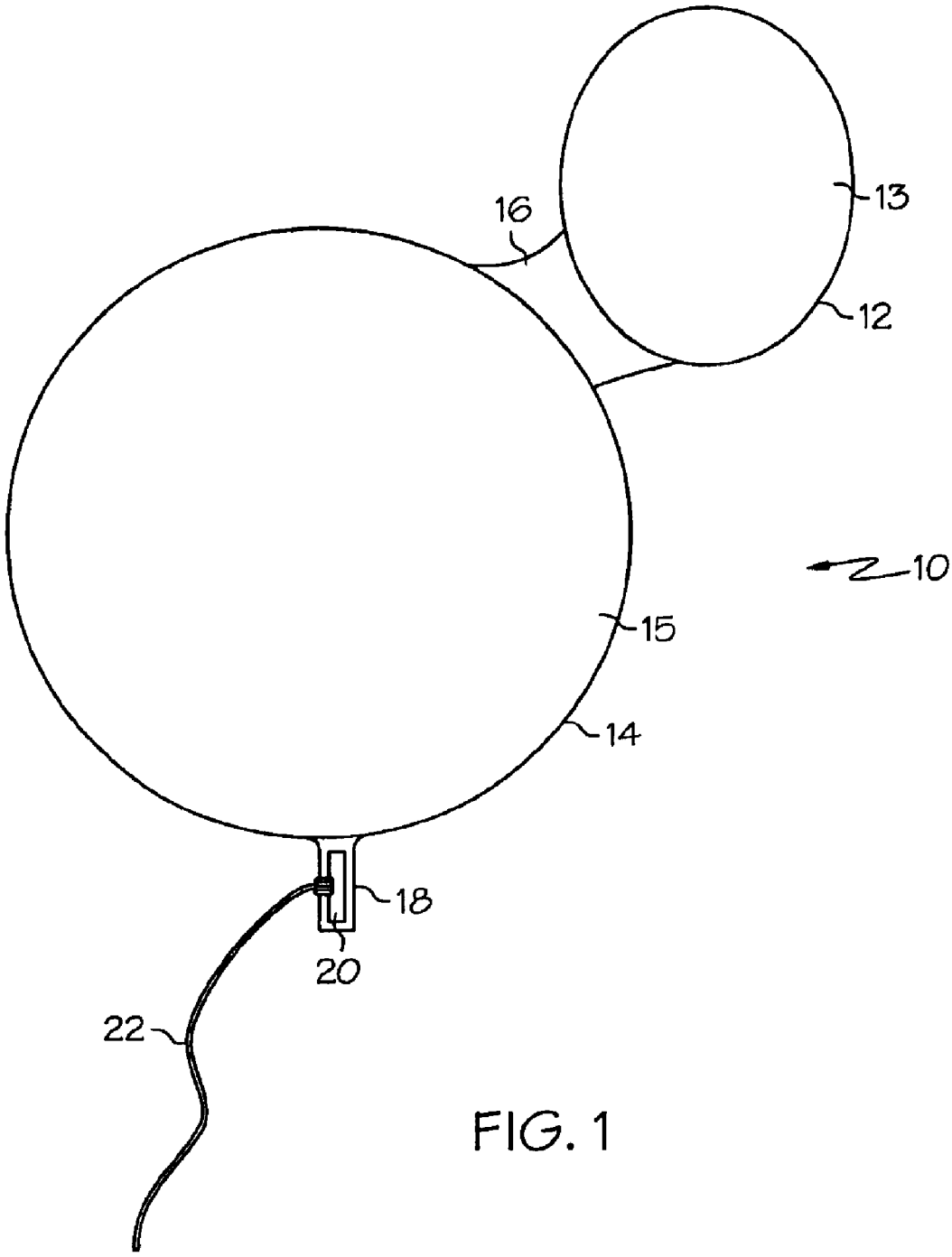
FIG. 1 is a schematic view of one embodiment of the invention.

Referring now to the drawings, wherein like reference numerals designate corresponding structure throughout the views, and referring in particular to FIG. 1, a balloon device 10 according the first embodiment of the invention includes a first aesthetically discrete balloon member 12, a second aesthetically discrete balloon member 14, and a connecting member 16 connecting to both objects 12 and 14. Aesthetically discrete means an object looks like an individual moiety when being casually viewed. In other words, the first balloon member 12, which is shown schematically in FIG. 1, defines a first aesthetic moiety while the second balloon member 14 similarly defines a second aesthetic moiety. Both balloons 12 and 14 are preferably of the non-latex variety, are formed of a thin film resin, and are preferably made to be inflatable and to exhibit distinctive colors. Connecting member 16 may be an inflatable air passageway, which may be transparent, translucent or having the color of the background where balloon device 10 is intended to be displayed. Air or other suitable gases such as hydrogen or helium within an internal space 13 defined by first balloon 12 may communicate with the air or other suitable gases with an internal space 15 defined by second balloon 14 through connecting member16. Accordingly, when balloon device 10 is inflated and viewed from a particular angle such as shown in FIG. 1, balloon device 10 looks like two discrete moieties objects 12 and 14 arranged in a specific spatial arrangement, because of the transparency of connecting member 16, even though balloon device 10, in fact, is a single device made of connected components.

In a preferred embodiment, balloon device 10 may further include an air inlet 18 connected to second balloon member 14 so that balloon device 10 may be inflated by injecting air or other suitable gases into object second balloon member 14 via air inlet 18. Air inlet 18 may further include a check valve which only allows air or other suitable gases to flow therethrough in one direction (into second balloon member 14) so that the check valve may provide an automatic seal once balloon device 10 is removed from an air or gas filling apparatus. Balloon device 10 may further include a flexible elongated member 22, such as a ribbon or string, tied to the balloon device 10 at a suitable location close to air inlet 18.

Figure 2:
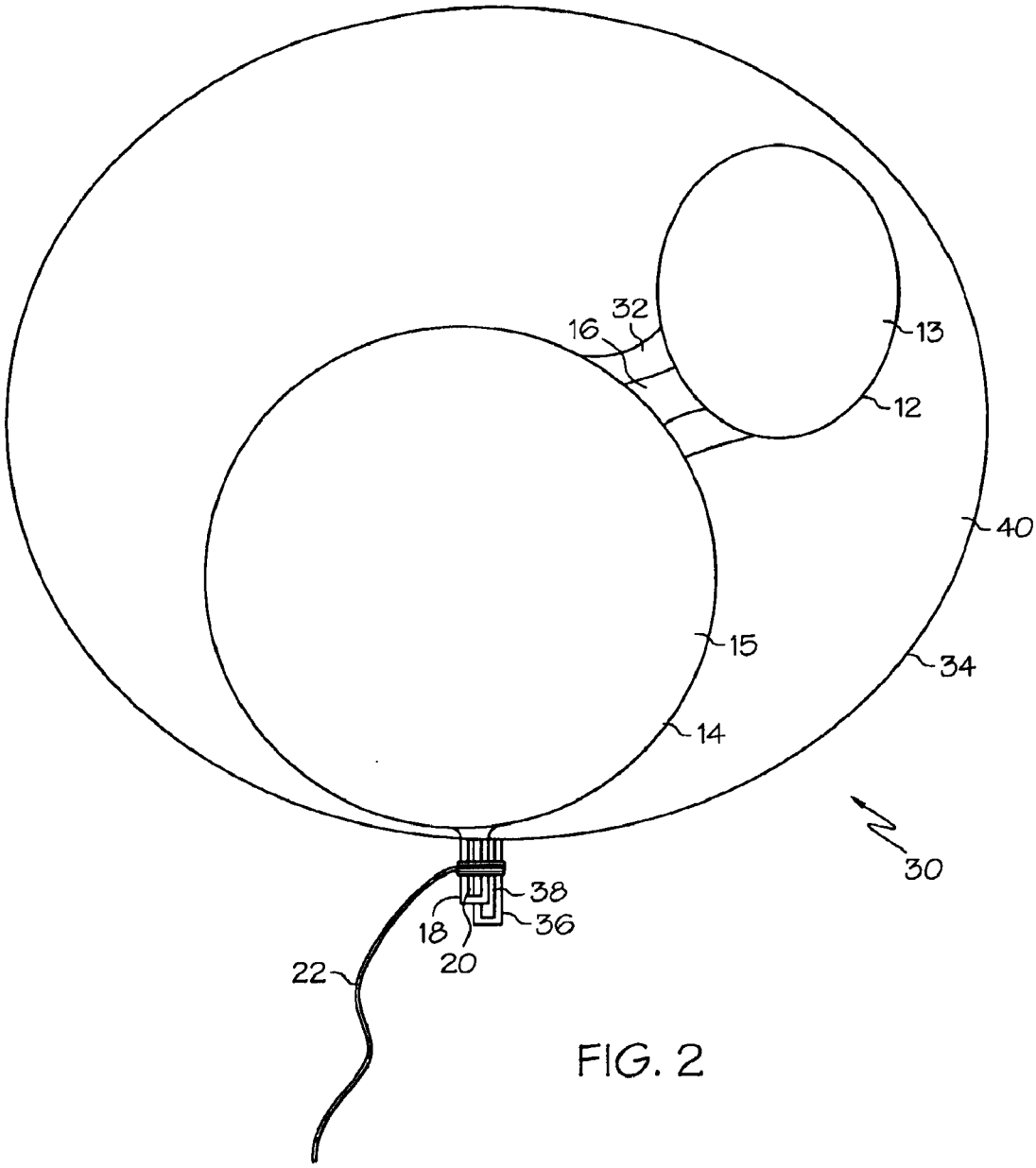
FIG. 2 is a schematic view of a second embodiment of the invention.
Figure 3:
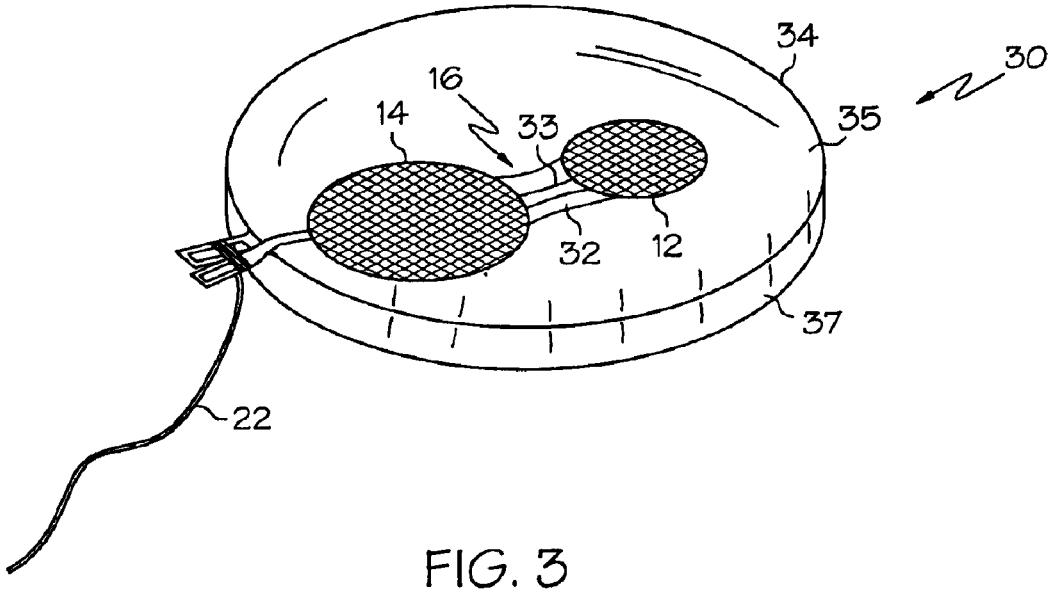
FIG. 3 is a perspective view of the second embodiment of the invention.

Referring now to FIGS. 2 and 3, another balloon device 30 that is constructed according to a second embodiment of the invention, includes a first aesthetically discrete object first balloon member 12, a second aesthetically discrete object second balloon member 14, a connecting member 16 connecting to both objects first balloon member 12 and second balloon member 14. Both first balloon member 12 and second balloon member 14 may be inflatable balloons having distinctive colors. Connecting member 16 may include an inflatable air passageway 33, which may be transparent, translucent or have the color of the background against which balloon device 30 is intended to be displayed. Connecting member 16 may further include noninflatable portions 32 attached to the air passageway 33. Noninflatable portion 32 may be transparent, translucent or having the color of the background against which balloon device 30 is intended to be displayed. The word background in this case may be defined as including a nontransparent portion of an outer, encapsulating balloon member 34, or as including an external background surface or view against which the balloon device 30 is intended to be displayed. Air or other suitable gases such as hydrogen or helium within an internal space 13 defined by first balloon member 12 may communicate with the air or other suitable gases with an internal space 15 defined by second balloon member 14 through connecting member 16. Accordingly, when balloon device 30 is inflated and viewed from a particular angle such as shown in FIG. 2 or 3, balloon device 30 looks like two discrete moieties, respectively defined by the first balloon member 12 and second balloon member 14, because of the transparency of connecting member 16, even though balloon device 30, in fact, is a single device made of connected components.

In a preferred embodiment, balloon device 30 may further include an air inlet 18 connected to second balloon member 14 so that first balloon member 12, second balloon member 14 and connecting member 16 may be inflated by injecting air or other suitable gases into object second balloon member 14 via air inlet 18. Air inlet 18 may further include a check valve which only allows air or other suitable gases to flow therethrough in one direction (into second balloon member 14) so that the check valve may provide an automatic seal once balloon device 30 is removed from an air filling apparatus. Balloon device 30 may also include an encapsulating device 34 such as a transparent or translucent balloon or a balloon having at least a portion of its surface (e.g., the films that form the balloon) being transparent or translucent, substantially encapsulating first balloon member 12 and second balloon member 14, and connecting member 16 therein. In other words, objects first balloon member 12 and second balloon member 14, and connecting member 16 are substantially located within an internal space 40 defined by encapsulating device 34 as shown in FIGS. 2 and 3. In this particular embodiment, the top portion 35 of encapsulating device 34 is transparent, whereas the bottom portion 37 of encapsulating device 34 is not transparent and has a particular color or pattern as shown in FIG. 3. Balloon device 30 may also includes another air inlet 36 that is connected to encapsulating device 34 so that encapsulating device 34 may be inflated by injecting air or other suitable gases into encapsulating device 34 via air inlet 36. Air inlet 36 may further include a check valve 38 so that the check valve may provide an automatic seal once encapsulating device 34 is removed from an air filling apparatus. In this particular embodiment, encapsulating device 34 can be independently inflated via the air inlet 36 connected thereto. Balloon device 30 may further include an elongated member 22, such as a ribbon or string, attached to the balloon device 30 at a suitable location such as a place close to air inlet 18.

Figure 4:
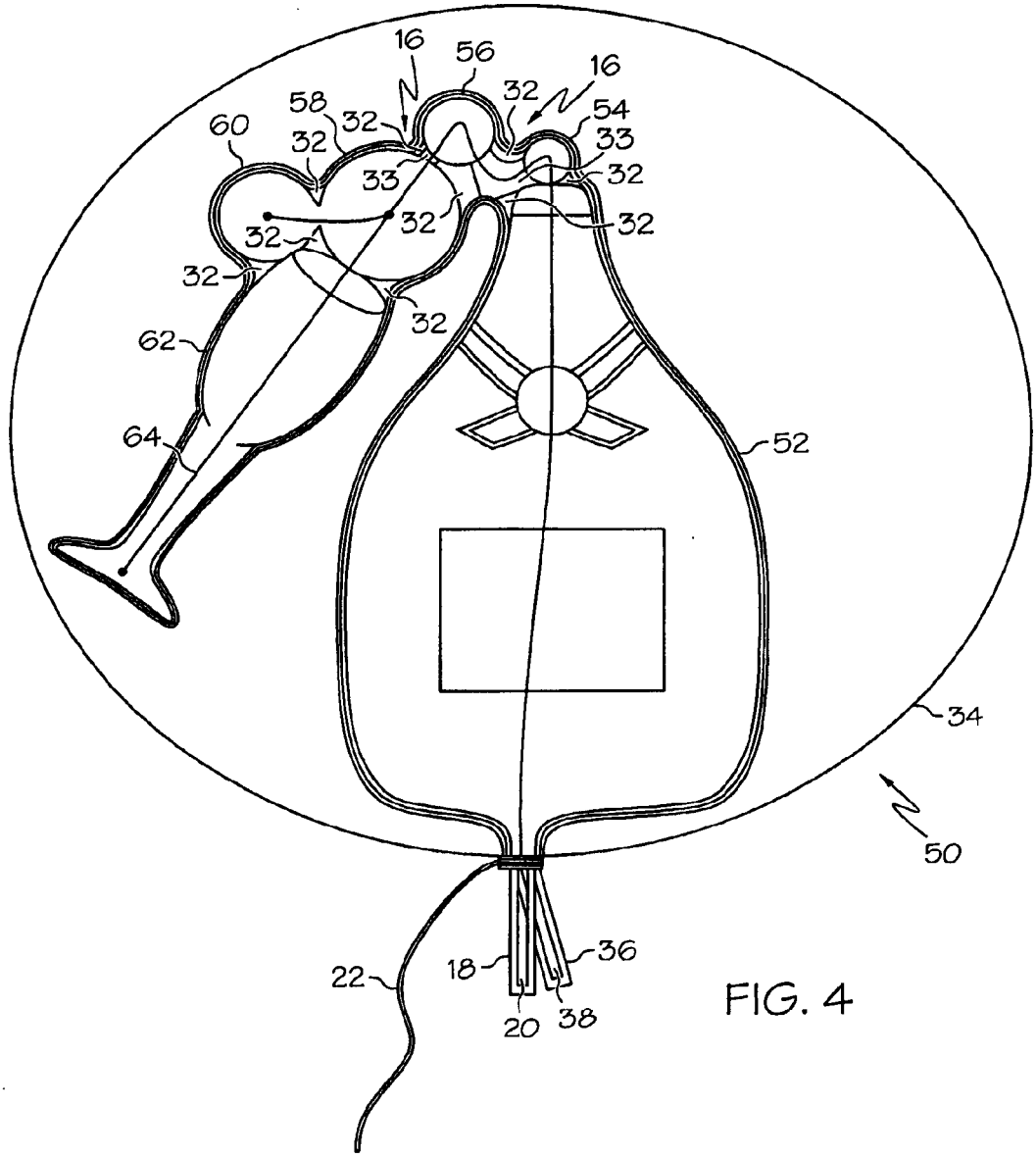
FIG. 4 is a schematic view of a third embodiment of the invention.

Referring now to FIG. 4, a balloon device 50 that is constructed according to a third embodiment of the invention includes a first aesthetically discrete balloon member 52, a second aesthetically discrete balloon member 54, a third aesthetically discrete balloon member 56, a fourth aesthetically discrete balloon member 58, a fifth aesthetically discrete balloon member 60 and a sixth aesthetically discrete balloon member 62. Balloon members 52 and 54 are in communication via a noninflatable portion 32. In communication as defined herein means two objects that both define spaces therein that can be used to hold air or other suitable gases are connected in such a way that the gases can flow from one to the other directly or indirectly through a suitable passage way. Balloon members 54 and 56 are in communication via a connecting member 16, which in turn includes an air passageway 33 and non-inflatable components 32. Balloon members 56 and 58 are in communication via another connecting member 16, which in turn includes another air passageway 33 and non-inflatable components 32. Balloon members 58 and 60 are in communication directly and further connected via non-inflatable portions 32. Balloon members 58 and 62 are in communication directly and are further connected via non-inflatable portions 32. Balloon members 60 and 62 are connected via non-inflatable portions 32. Balloon member 52 is connected to an air inlet 18, which further includes a check valve 20. Balloon members 52, 54, 56, 58, 60 and 62 may be inflated by air or other suitable gases via air inlet 18 as being schematically illustrated by air flow pathway 64. Balloon member 50 further include an encapsulating member 34, which may be a transparent balloon, completely encapsulating balloon members 52, 54, 56, 58, 60 and 62, connecting components 16 and non-inflatable portions 32 connected therebetween. Balloon device 50 may also includes another air inlet 36 connected to encapsulating device 34 so that encapsulating member 34 may be inflated by injecting air or other suitable gases into encapsulating device 34 via air inlet 36. Air inlet 36 may further include a check valve 38 so that the check valve may provide an automatic seal once encapsulating member 34 is removed from an air filling apparatus. In this particular embodiment, encapsulating member 34 can be independently inflated via the air inlet 36 connected thereto. Balloon device 50 may further include a flexible elongated member 22, such as a ribbon or string, attached to the balloon device 50 at a suitable location such as a place close to air inlet 18.

The aesthetically discrete balloon members, encapsulating members and connecting components used in the present invention may be made from are formed from sheets of synthetic resin film or a rigid material such as rigid plastic. The aesthetically discrete balloon members, encapsulating members and connecting members may be inflatable or non-inflatable. In a preferred embodiment, the aesthetically discrete objects, encapsulating device, connecting components used in the present invention may be made from are formed from sheets of soft synthetic resin film and are inflatable.

Figure 5:
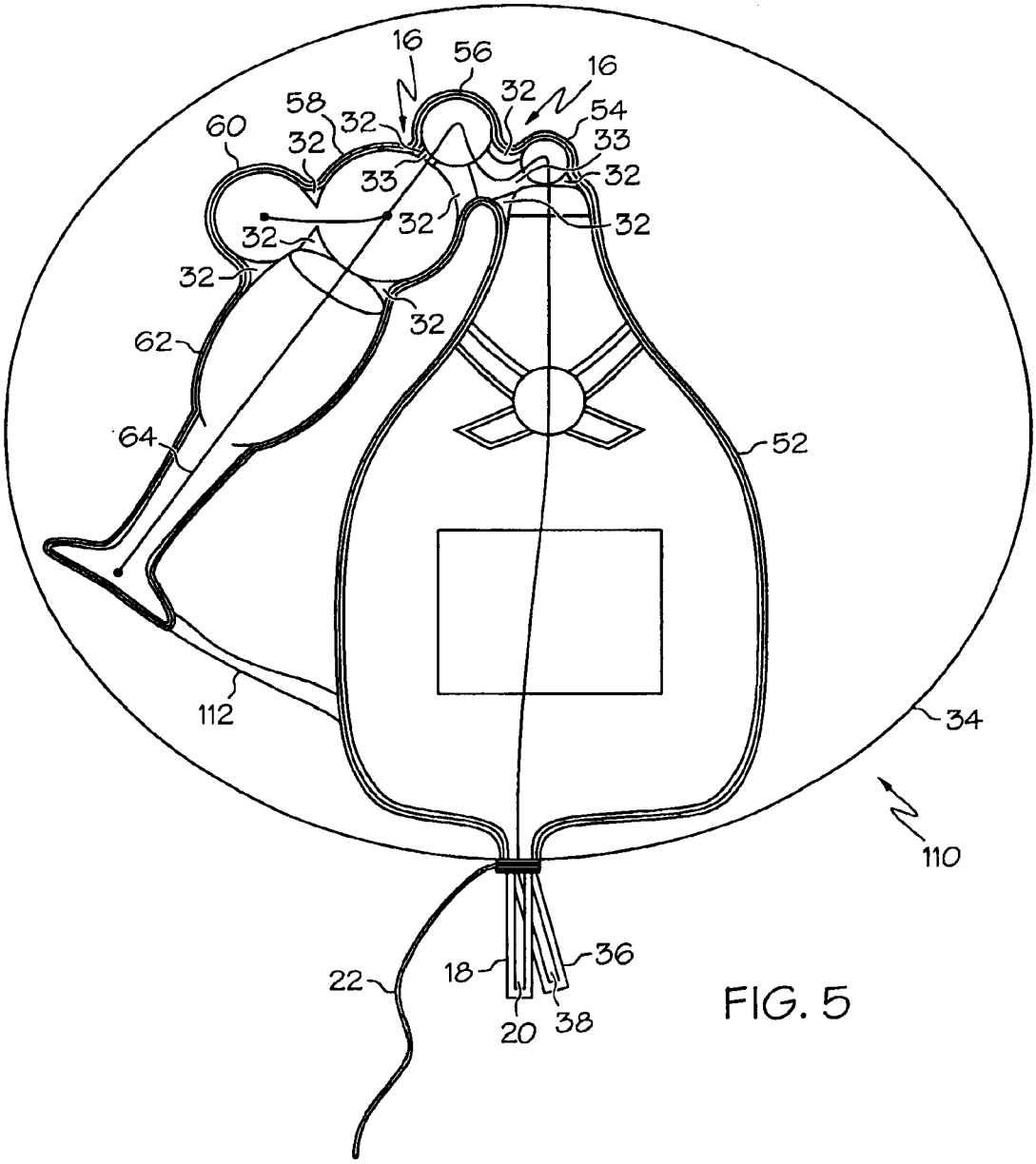
FIG. 5 is a schematic view of a fourth embodiment of the invention.

FIG. 5 depicts an alternative embodiment of the invention depicting a balloon device 110 that is identical in all respects to the embodiment that is previously described with respect to FIG. 4, except that it includes a connecting member 112 that does not have an air passageway defined therein but that is constructed so as to maintain aesthetic differentiation between the first aesthetic moiety that is defined by the balloon member 52 and the second aesthetic moiety that is defined by the balloon member 62.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A balloon device comprising:

an inflatable encapsulation member, said encapsulation member comprising at least one portion that is substantially transparent;

a first balloon member positioned within said inflatable encapsulation member, said first balloon member defining a first aesthetic moiety;

a second balloon member that is in communication with said first balloon member, said second balloon member being positioned within said inflatable encapsulation member and defining a second aesthetic moiety; and a connecting member attached at a first location to said first balloon member and attached at a second location to said second balloon member, said connecting member having an appearance that maintains an aesthetic separation between the first and second aesthetic moieties.

2. A balloon device according to claim 1, wherein said encapsulation member comprises a transparent balloon.

3. A balloon device as claimed in claim 1, wherein said first balloon member is fabricated from a material comprising synthetic resin film.

4. A balloon device as claimed in claim 1, wherein said second balloon member is fabricated from a material comprising synthetic resin film.

5. A balloon device as claimed in claim 1, wherein said encapsulation member is fabricated from a material comprising synthetic resin film.

6. A balloon device as claimed in claim 1, wherein said inflatable encapsulation member further comprises an air inlet.

7. A balloon device as claimed in claim 6, wherein said air inlet has a check valve positioned therein.

8. A balloon device as claimed in claim 1, wherein said connecting member further comprises a non-inflatable portion that has an appearance that maintains an aesthetic separation between the first and second aesthetic moieties.

9. A balloon device according to claim 8, wherein said non-inflatable portion of said connecting member is substantially transparent.

10. A balloon device according to claim 8, wherein said non-inflatable portion of said connecting member is designed so as to create the appearance of a void between said first balloon member and said second balloon member.

11. A balloon device as claimed in claim 1, wherein at least one of said balloon members comprises an air inlet.

12. A balloon device as claimed in claim 11, wherein said air inlet comprises a check valve.

13. A balloon device as claimed in claim 1, further comprising an elongated member connected to at least one of said aesthetically discrete objects.

14. A balloon device as claimed in claim 1, wherein said first and second balloon members are both inflatable.

15. A balloon device as claimed in claim 1, wherein said connecting member is inflatable.

16. A balloon device as claimed in claim 1, wherein said connecting member further has at least one passageway defined therein for communicating said first balloon member with said second balloon member.

17. A balloon device comprising:

a first balloon member, said first balloon member defining a first aesthetic moiety;

a second balloon member, said second balloon member defining a second aesthetic moiety; and transparent structure communicating said first and second balloon members, and wherein said first balloon member, said second balloon member and said transparent structure are configured and arranged so as to maintain an aesthetic separation between the first and second aesthetic moieties.

18. A balloon device as claimed in claim 17, further comprising an air inlet connected to said first balloon member.

19. A balloon device as claimed in claim 17, further comprising an inflatable encapsulating member encapsulating said first and second aesthetically discrete balloon members and said transparent structure, and wherein at least a portion of said inflatable encapsulating member is transparent.

20. A balloon device as claimed in claim 19, further comprising a first air inlet connected to said first balloon member; and a second air inlet connected to said inflatable encapsulating member.

21. A balloon device as claimed in claim 19, wherein said first and second balloon members and said encapsulating device are made from thin resin films.

22. A balloon device as claimed in claim 17, wherein said transparent structure has a passageway defined therein for communicating said first balloon member with said second balloon member.

* * * * *